US006460636B1

(12) United States Patent
Yong et al.

(10) Patent No.: US 6,460,636 B1
(45) Date of Patent: Oct. 8, 2002

(54) DRILL BIT INSERTS WITH VARIATIONS IN THICKNESS OF DIAMOND COATING

(75) Inventors: Zhou Yong, The Woodlands, TX (US); Suprant J. Huang, The Woodlands, TX (US); Nathan R. Anderson, Pleasant Grove, UT (US); J. Daniel Belnap, Pleasant Grove, UT (US); Chris E. Cawthorne, The Woodlands, TX (US); Ronald K. Eyre, Orem, UT (US); Madapusi K. Keshavan, Sandy, UT (US); Per I. Nese, Aberdeen (GB); Michael A. Siracki, The Woodlands, TX (US); Gary R. Portwood, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/465,631

(22) Filed: Dec. 17, 1999

Related U.S. Application Data

(63) Continuation-in-part of application No. 09/023,264, filed on Feb. 13, 1998, now Pat. No. 6,199,645, and a continuation-in-part of application No. 09/293,190, filed on Apr. 16, 1999, now Pat. No. 6,315,065, and a continuation-in-part of application No. 09/293,372, filed on Apr. 16, 1999, now Pat. No. 6,260,639.

(51) Int. Cl.[7] ..... E21B 10/46
(52) U.S. Cl. ..... 175/428; 175/426
(58) Field of Search ..... 175/426, 428, 175/431, 432, 420.1, 420.2

(56) References Cited

U.S. PATENT DOCUMENTS 4,108,260 A * 8/1978 Bozarth ..... 175/374
4,705,124 A * 11/1987 Abrahamson et al. ..... 175/410
5,370,195 A * 12/1994 Keshavan et al. ..... 175/420.2
5,544,713 A * 8/1996 Dennis ..... 175/434
5,706,906 A * 1/1998 Jurewicz et al. ..... 175/428
5,743,346 A * 4/1998 Flood et al. ..... 175/420.2
5,829,541 A * 11/1998 Flood et al. ..... 175/426
5,871,060 A * 2/1999 Jensen et al. ..... 175/420.2
5,881,830 A * 3/1999 Cooley ..... 175/428
5,890,552 A 4/1999 Scott et al. ..... 175/426
6,105,694 A * 8/2000 Scott ..... 175/428
6,199,645 B1 * 3/2001 Anderson et al. ..... 175/426

FOREIGN PATENT DOCUMENTS

EP 0692607 A2 1/1996 ..... E21B/10/56
EP 0692607 A3 9/1997 ..... E21B/10/56
GB 23342787 A 8/1999 ..... E21B/10/16

OTHER PUBLICATIONS

U.K. Patent Search Report for Application GB0030664.7 dated Apr. 18, 2001.

* cited by examiner

*Primary Examiner*—David Bagnell
*Assistant Examiner*—John Kreck
(74) *Attorney, Agent, or Firm*—Conley, Rose & Tayon, P.C.

(57) ABSTRACT

A cutter element for use in a drill bit, comprising a substrate and a cutting layer. The substrate comprises a grip portion and an extension portion, where the grip portion has an insert axis and an extension portion including an interface surface having a first apex. The cutting layer is affixed to the interface surface and has a cutting surface having a second apex. The cutting layer is shaped such that when a plane passing through the first apex and lying parallel to the insert axis and normal to a radius from the insert axis, the plane divides the cutting layer into major and minor portions and the major portion has a major volume that is at least 60 percent of the total volume of said cutting layer. Alternative embodiments of the present invention include variations wherein the first and second apices do not coincide and wherein the interface surface of the substrate is not axisymmetric. Using these variations, cutter elements having sizeable variations in thickness are constructed.

24 Claims, 3 Drawing Sheets

DRILL BIT INSERTS WITH VARIATIONS IN THICKNESS OF DIAMOND COATING

RELATED APPLICATIONS

This application is a continuation-in-part of U.S. Ser. No. 09/023,264 filed Feb. 13, 1998, now U.S. Pat. No. 6,199,645 Ser. No. 09/293,190, filed Apr. 16, 1999 now U.S. Pat. No. 6,315,065; and Ser. No. 09/293,372, filed Apr. 16, 1999 now U.S. Pat. No. 6,260,639, all of which are incorporated herein in their entireties.

TECHNICAL FIELD OF THE INVENTION

The present invention relates generally to cutting elements for use in earth-boring drill bits and, more specifically, to a means for increasing the life of cutting elements that comprise a layer of superhard material, such as diamond, affixed to a substrate. Still more particularly, the present invention relates to a polycrystalline diamond enhanced insert comprising a supporting substrate and a diamond layer supported thereon.

BACKGROUND OF THE INVENTION

In a typical drilling operation, a drill bit is rotated while being advanced into a soil or rock formation. The formation is cut by cutting elements on the drill bit, and the cuttings are flushed from the borehole by the circulation of drilling fluid that is pumped down through the drill string and flows back toward the top of the borehole in the annulus between the drill string and the borehole wall. The drilling fluid is delivered to the drill bit through a passage in the drill stem and is ejected outwardly through nozzles in the cutting face of the drill bit. The ejected drilling fluid is directed outwardly through the nozzles at high speed to aid in cutting, flush the cuttings and cool the cutter elements.

The present invention is described in terms of cutter elements for roller cone drill bits, although its benefits can be realized in percussion bits as well as other fixed cutter bits. In a typical roller cone drill bit, the bit body supports three roller cones that are rotatably mounted on cantilevered shafts, as is well known in the art. Each roller cone in turn supports a plurality of cutter elements, which cut and/or crush the wall or floor of the borehole and thus advance the bit.

Conventional cutting inserts typically have a body consisting of a cylindrical grip portion from which extends a convex protrusion. In order to improve their operational life, these inserts are preferably coated with a superhard, sometimes also known as ultrahard, material. The coated cutting layer typically comprises a superhard substance, such as a layer of polycrystalline diamond, thermally stable diamond or any other ultrahard material. The substrate, which supports the coated cutting layer is normally formed of a hard material such as tungsten carbide (WC). The substrate typically has a body consisting of a cylindrical grip from which extends a convex protrusion. The grip is embedded in and affixed to the roller cone and the protrusion extends outwardly from the surface of the roller cone. The protrusion, for example, may be hemispherical, which is commonly referred to as a semi-round top (SRT), or may be conical, or chisel-shaped or may form a crest that is inclined relative to the plane of intersection between the grip and the protrusion. The latter embodiment, along with other non-axisymmetric shapes, is becoming more common, as the cutter elements are designed to provide optimal cutting for various formation types and drill bit designs.

The basic techniques for constructing polycrystalline diamond enhanced cutting elements are generally well known and will not be described in detail. They can be summarized as follows: a carbide substrate is formed having a desired surface configuration; the substrate is placed in a mold with a superhard material, such as diamond powder and/or a mixture of diamond with other material that forms transition layers, and subjected to high temperature and pressure, resulting in the formation of a diamond layer bonded to the substrate surface.

Although cutting elements having this configuration have significantly expanded the scope of formations for which drilling with diamond bits is economically viable, the interface between the substrate and the diamond layer continues to limit usage of these cutter elements, as it is prone to failure. Specifically, it is not uncommon for diamond coated inserts to fail during cutting. Failure typically takes one of three common forms, namely spalling/chipping, delamination, and wear. External loads due to contact tend to cause failures such as fracture, spalling, and chipping of the diamond layer. The impact mechanism involves the sudden propagation of a surface crack or internal flaw initiated on the PCD layer, into the material below the PCD layer until the crack length is sufficient for spalling, chipping, or catastrophic failure of the enhanced insert. On the other hand, internal stresses for example, thermal residual stresses resulting from manufacturing process, tend to cause delamination of the diamond layer, either by cracks initiating along the interface and propagating outward, or by cracks initiating in the diamond layer surface and propagating catastrophically along the interface. Excessively high contact stress and high temperature, along with a very hostile downhole operation environment, are known to cause severe wear to the diamond layer of cutting elements in percussion bits. The wear mechanism occurs due to the relative sliding of the PCD relative to the earth formation, and its presence as a failure mode is related to the basic bit type, abrasiveness of the formation, as well as other factors such as formation hardness or strength, and the amount of relative sliding involved during contact with the formation. Wear is not a typical failure mode in roller cone drill bits that utilize conventional diamond coated cutting elements. Instead, fatigue and impact of the diamond coating are the typical failure modes found.

One explanation for failure resulting from internal stresses is that the interface between the diamond and the substrate or a transition layer is subject to high residual stresses resulting from the manufacturing processes of the cutting element. Specifically, because manufacturing occurs at elevated temperatures, the differing coefficients of thermal expansion of the diamond and substrate material result in thermally-induced stresses as the materials cool down from the manufacturing temperature. These residual stresses tend to be larger when the diamond/substrate interface has a smaller radius of curvature. At the same time, as the radius of curvature of the interface increases, the application of cutting forces due to contact on the cutter element produces larger debonding and other detrimental stresses at the interface, which can result in delamination. In addition, finite element analysis (FEA) has demonstrated that during loading, high stresses are localized in both the outer diamond layer and at the diamond transition-layer/tungsten carbide interface. Finally, localized loading on the surface of the inserts causes rings or zones of tensile stress, which the PCD layer is not capable of handling.

In drilling applications, the cutting elements are subjected to extremes of temperature and heavy loads when the drill bit is in use. It has been found that during drilling, shock waves may rebound from the internal planar interface between the two layers and interact destructively.

All of these phenomena are deleterious to the life of the cutting element during drilling operations. More specifically, the residual stresses, when augmented by the repetitive stresses attributable to the cyclical loading of the cutting element by contact with the formation, may cause spalling, fracture and even delamination of the diamond layer from the substrate. In addition to the foregoing, state of the art cutting elements can lack sufficient diamond volume to cut highly abrasive formations, as the thickness of the diamond layer tends to be limited by the resulting high residual stresses and the difficulty of bonding a relatively thick diamond layer to a curved substrate surface. For example, even within the diamond layer, residual stresses arise as a result of temperature changes. Because these stresses typically increase as the thickness of the layer increases, this factor tends to be viewed as limiting on thickness.

Hence, it is desired to provide cutting elements that provide increased fatigue life, and/or impact resistance and/or wear resistance without increasing the risk of spalling or delamination.

SUMMARY OF THE INVENTION

The present invention provides a diamond cutting element with increased life expectancy. The improved cutting element has an optimized substrate/coating interface and incorporates a region of exceptional thickness in its cutting layer. This region of thicker diamond on the cutting element is oriented so that it is the primary cutting surface and sustains the major loading while cutting the rock formation. The improved diamond cutting element has several advantages. One advantage is that the exceptionally thick diamond region is stronger and more rigid, which significantly reduces localized deformation under loading. When the localized deformations are reduced, the associated Hertzian tensile stresses are reduced, which ultimately reduces or eliminates chipping and breaking of the diamond coating. Another advantage of the stronger, more rigid diamond layer region is that it reduces the bending stresses at the substrate/coating interface when the cutting surface is loaded, which reduces the potential for coating debonding and/or breakage. Yet another advantage is that substrate/coating interface is farther away from the loaded cutting surface of the cutter element, therefore keeping the maximum shear stresses away from the substrate/coating interface, which is typically a relatively weak part of a diamond coated cutter element. Still yet another advantage is that because the cutter element has thicker, greater volume of diamond on the cutting surface, a tougher diamond grade can be utilized. Generally, a diamond grade that has increased toughness over another grade also has less wear resistance, thus the increase in the volume of diamond material to wear away is beneficial. If an increase in toughness is not required, the overall wear resistance of the cutter element is improved just through the increased volume in the diamond in the contact region.

The present cutter element compensates for the resulting residual stresses that might otherwise be caused by a region of exceptional thickness by providing an interface geometry that balances the reduction in bending stresses associated with the region of increased thickness with the increase in interface delamination stresses resulting from a decreased radius of curvature. The interface is designed so that even without transition layers or a non-planar interface, the residual stress due to thermal mismatch is still minimized. More specifically, the present cutter element provides a region of exceptional thickness that has a preferred volume ratio to the volume of the cutting layer and provides a cutting layer that has a preferred volume ratio to the volume of the protrusion portion of the cutter element.

The region of exceptional thickness can be defined in the present invention in terms of volume ratios of the cutting layer in various regions of the cutting surface, or can alternatively be defined in terms of the configurations of the substrate and cutting layers. In each instance, one objective of the present invention is to provide a variation in cutting layer thickness, so that the cutting layer in the region of the cutter element that is expected to receive the most wear is thicker than in other portions of the cutting surface.

In one embodiment, a cutter element for use in a drill bit comprises a substrate comprising a grip portion and an extension portion, where the grip portion has an insert axis and the extension portion has a substrate apex. A superhard cutting layer is affixed to the extension portion. The cutting layer covers the substrate apex and defines an interface surface on the extension portion, the interface surface being free of edges underneath the cutting layer, and the cutting layer having a cutting surface that defines a cutting apex. The cutting layer and extension portion are shaped such that a plane can be passed through the insert axis to divide the cutting layer where the volume of the cutting layer on a first side of the plane is at least 60 percent of the total volume of the cutting layer.

In another embodiment, a cutter element for use in a drill bit comprises a substrate comprising a grip portion and an extension portion, the grip portion having an insert axis and the extension portion having a substrate apex, and a superhard cutting layer affixed to the extension portion to define an interface surface on the extension portion and having a cutting surface, wherein the cutting layer and the extension portion are shaped such that a plane can be passed through the insert axis to divide the cutting layer such that the volume of cutting layer on one side of the plane is at least 60 percent of the total volume of the cutting layer and wherein the cutting surface is axisymmetric.

In still another embodiment, a cutter element for use in a drill bit comprises a substrate comprising a grip portion and an extension portion, the grip portion having an insert axis and the extension portion having a substrate apex. A superhard cutting layer is affixed to the extension portion to define an interface surface on the extension portion. The cutting layer has a cutting surface. The cutting layer and the extension portion are shaped such that a plane can be passed through the insert axis to divide the cutting layer such that the volume of cutting layer on one side of the plane is at least 60 percent of the total volume of the cutting layer and wherein the cutting surface is free of cutting edges.

In still another embodiment, a cutter element for use in a drill bit comprises a substrate comprising a grip portion and an extension portion, the grip portion having an insert axis and the extension portion having a substrate apex. A superhard cutting layer is affixed to the extension portion to define an interface surface on the extension portion. The cutting layer has a cutting surface defining a cutting apex. The cutting layer and the extension portion are shaped such that a plane can be passed through the insert axis to divide the cutting layer such that the volume of the cutting layer on a first side of the plane is at least 75 percent of the total volume of the cutting layer.

In still another embodiment, a cutter element for use in a drill bit comprises a substrate comprising a grip portion and an extension portion, the grip portion having an insert axis and the extension portion having a substrate apex. A superhard cutting layer is affixed to the extension portion so as to define an interface surface on the extension portion. The cutting layer has a cutting surface defining a cutting apex that is offset from the substrate apex, the cutting layer covering the substrate apex. The substrate and the cutting layer are shaped such that the insert axis does not pass through the substrate apex, and a plane parallel to the insert axis can be passed through the substrate apex to divide the cutting layer such that the volume of the cutting layer on a first side of the plane is at least 75 percent of the total volume of the cutting layer.

In still another embodiment, a cutter element for use in a drill bit comprises a substrate comprising a grip portion and an extension portion, the grip portion having an insert axis and the extension portion having a substrate apex. A superhard cutting layer is affixed to the extension portion, the cutting layer covering the substrate apex. The substrate and the cutting layer are shaped such that a plane parallel to the insert axis and passing through the first apex divides the cutting layer such that the volume of the cutting layer on a first side of the plane is at least 60 percent of the total volume of the cutting layer and the cutting surface is axisymmetric.

In another embodiment, a cutter element for use in a drill bit comprises a substrate comprising a grip portion and an extension portion, the grip portion having an insert axis and the extension portion having a substrate apex. A superhard cutting layer is affixed to the extension portion. The substrate and the cutting layer are shaped such that a plane parallel to the insert axis and passing through the first apex divides the cutting layer such that the volume of the cutting layer on a first side of the plane is at least 60 percent of the total volume of the cutting layer and the cutting surface is free of cutting edges.

Another cutter element for use in a drill bit comprises a substrate comprising a grip portion and an extension portion, said grip portion having an insert axis, the extension portion having a volume $V_{ext}$. A superhard cutting layer is affixed to the extension portion so as to define an interface surface on the extension portion and having a cutting surface defining a cutting apex, the entire cutting layer having a volume $V_{cl}$. The extension portion and the cutting layer are configured such that a plane P* can be passed through the insert axis such that the ratio of the volume of the cutting layer on a first side of the plane P* to the total volume on the first side of the plane ($V_{cl-1}$*: ($V_{ext-1}$*+$V_{cl-1}$*)) is at least 60 percent and less than 98% and the same ratio ($V_{cl-1}$*: ($V_{ext-1}$*+$V_{cl-1}$*)) is greater than a corresponding ratio on a second side of the plane ($V_{cl-2}$*: ($V_{ext-2}$*+$V_{cl-1}$*)) and the volume on the first side of the plane, $V_{cl-1}$*, is at least 60 percent of the total cutting layer volume, $V_{cl}$.

Another embodiment discloses a cutter element for use in a drill bit comprising a substrate comprising a grip portion and an extension portion, the grip portion having an insert axis and the extension portion having a substrate apex. A superhard cutting layer is affixed to the extension portion so as to define an interface surface. The cutting layer has a chisel-shaped cutting surface and wherein the substrate and the cutting layer are shaped such that a plane that includes the insert axis divides the cutting layer such that the volume of the cutting layer on a first side of the plane is at least 60 percent of the total volume of the cutting layer.

BRIEF DESCRIPTION OF THE DRAWINGS

For a detailed description of a preferred embodiment of the invention, reference will now be made to the accompanying Figures, wherein, except as indicated, the substrate and cutting layers are each shown in silhouette even when those silhouettes do not lie in a single plane, and wherein.

DETAILED DESCRIPTION OF THE PREFERRED EMBODIMENTS

Figure 1:
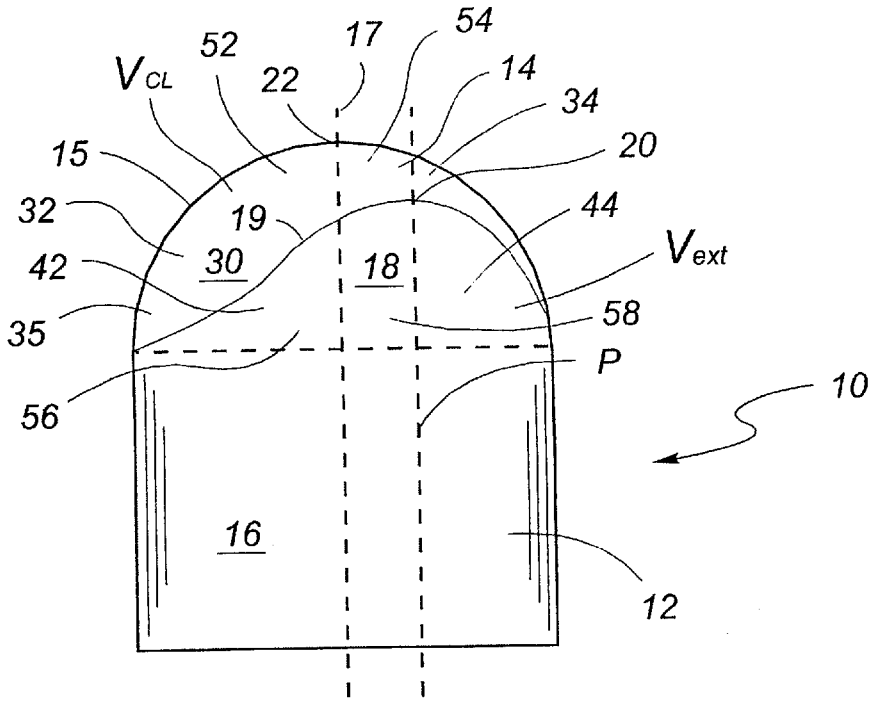
FIG. 1 is a cross sectional view of a cutting element constructed in accordance with a preferred embodiment of the invention.

Referring initially to FIG. 1, a cross sectional view of a cutting element 10 constructed in accordance with a first embodiment of the invention comprises a hard substrate 12, and a cutting layer 14. Substrate 12 comprises a body having a grip portion 16 and an extension portion 18. Grip portion 16 is typically cylindrical, although not necessarily circular in cross-section, and defines a longitudinal insert axis 17. Extension portion 18 includes an interface surface 19, which has an apex 20. Cutting layer 14 is affixed to interface surface 19 and includes an outer, cutting surface 15, which has an apex 22. The cutting layer 14 and the substrate extension portion 18 make up the protrusion portion 35 of the cutting element 10. Substrate 12 is preferably comprised of cemented carbide, preferably tungsten carbide, and abrasive cutting layer 14 is preferably comprised of abrasive particles bonded to substrate 12. The abrasive particles are preferably polycrystalline diamond, which may be supplemented with cobalt, but may be any of the other superhard abrasives, such as cubic boron nitride, diamond composite, etc.

Figure 2:
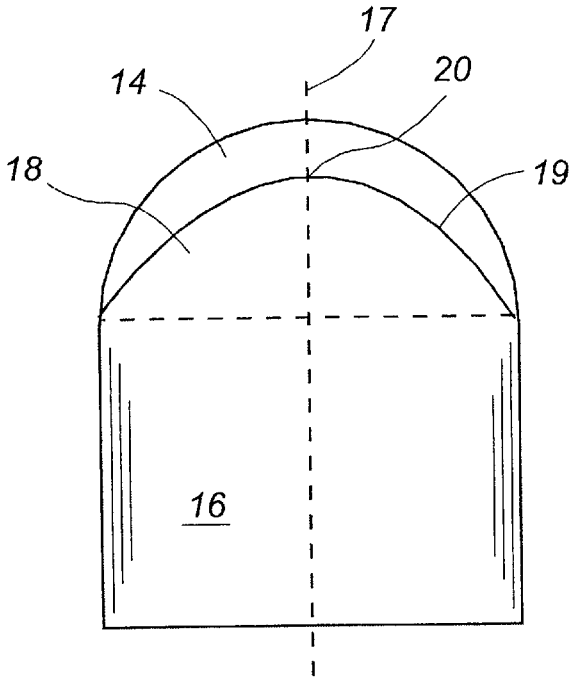
FIG 2 (Prior Art)
FIGS. 2 and 3 are cross-sectional views of prior art cutter elements.
Figure 3:
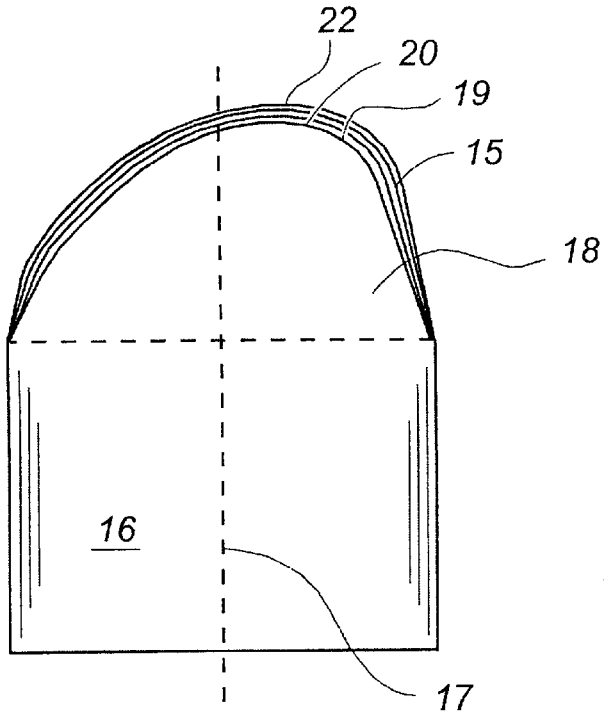
FIG 3 (Prior Art)

Referring briefly to FIG. 2, in prior art cutter elements, the surface 19 of extension portion 18 of substrate 12 is often axisymmetric, so that the apex 20 of substrate surface 19 coincides with the insert axis 17. In other prior art cutter elements, such as that shown in FIG. 3, the surface 19, while not axisymmetric, echoes the shape of the outer surface 15 of the cutting layer 14, so that the apex 20 of substrate surface 19 coincides with the apex 22 of cutting layer 14. As used herein, the term "apex" refers to the point on the surface in question that is farthest from the grip portion of the cutter element, as measured along the insert axis 17. If more than one point or a surface is of equal distance from the grip along the insert axis 17, than the central or centroid of the points or surface is considered as the apex. Although determination of the apex is made with respect to measurement along the insert axis, it will be understood that the apex of a surface does not necessarily lie on the insert axis 17 (see FIG. 3). Similarly, the term "coincide" is used to refer to points that lie on a line parallel to the insert axis, or on the axis itself. In each of the prior art types of cutter elements mentioned above, the shape of the cutting layer 14 has been limited by the inability to manufacture cutting layers thicker than a certain maximum thickness because of the residual stresses resulting from the manufacturing process.

Referring again to FIG. 1, the substrate apex 20 of the present cutter element does not coincide with the apex 22 of the cutting layer 14. Because the substrate apex 20 does not coincide with the cutting layer apex 22, a region of increased cutting layer thickness 30 is formed. The thickest portion of region 30 is preferably does not coincide with either the insert axis 17 or the apex 22 of the cutting layer 14. Likewise, the cutting layer apex 22 may, but does not have to, coincide with the insert axis 17 and the cutting surface 15 of cutting layer 14 may, but does not have to, be axisymmetric. It is preferred but not necessary that the cutting surface 15 be shaped or contoured so that it is free of cutting edges before use. It is recognized that certain wear patterns may ultimately cause the appearance of edges on the cutting surface, but these later-developed edges are not precluded by the present concept.

Figure 4:
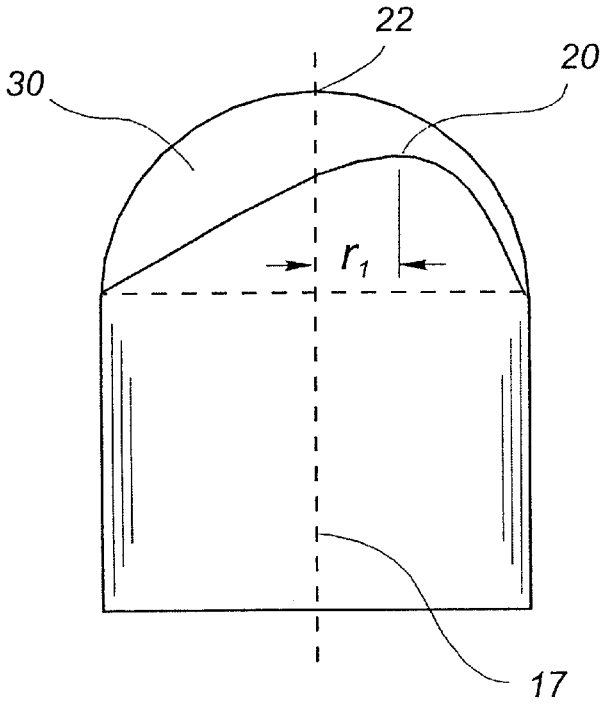
FIG. 4 is a cross-sectional view of a cutting element constructed in accordance with a second embodiment of the invention.
Figure 5:
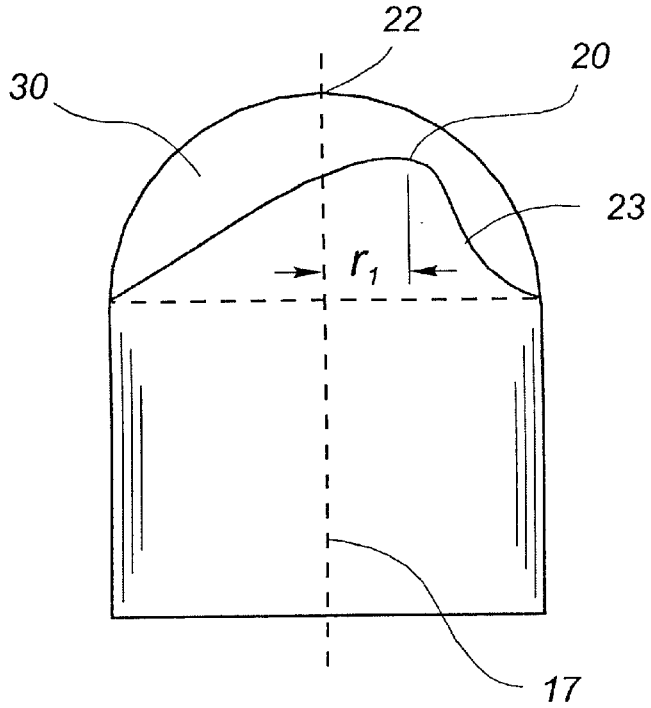
FIG. 5 is a cross-sectional view of a cutting element constructed in accordance with a third embodiment of the invention.

Further examples illustrating some of the embodiments reflecting these variations are shown in FIGS. 4 and 5. In FIG. 4, apex 20 is shifted away from insert axis 17 by a distance $r_1$, while cutting surface 15 remains hemispherical and apex 22 remains coincidental with insert axis 17. In FIG. 5, apex 20 is again shifted away from insert axis 17 by a distance $r_1$, while apex 22 remains coincidental with insert axis 17, but substrate surface 19 has been modified to include a concave portion 23.

Figure 6:
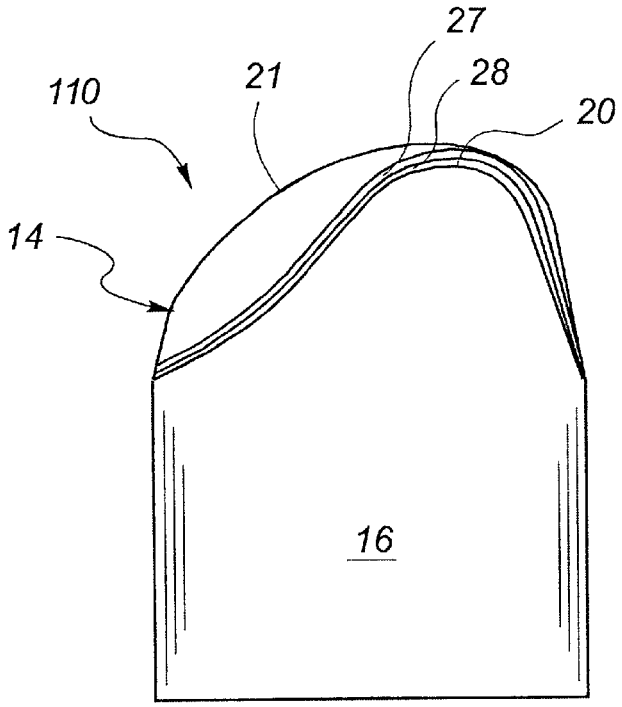
FIG. 6 is a cross-sectional view of a cutting element constructed in accordance with a fourth embodiment of the invention

FIG. 6 depicts a chisel insert 110 having an inclined crest 21, in which substrate apex 20 is shifted away from insert axis 17. As shown in FIG. 6, a preferred embodiment includes at least one, and sometimes more preferably two, transition layers 27, 28 between the cutting layer and the substrate. It is preferred that the cutting layer 14 cover the substrate apex 20. In addition, the substrate, transition layers and cutting layer are preferably shaped so that at least 60, and more preferably 75 percent of the total cutting layer lies on one side of a plane that includes the insert axis.

In each instance, it is preferred that cutting surface 15 be "contoured" or "sculpted," such that the cutting surface 15 is substantially free of cutting edges. In some embodiments, it is also preferred that the substrate surface also be contoured. The term "contoured" is intended to describe those surfaces that can be described as continuous curves. Portions of the continuous curve may be linear. The hemispherical, or SRT, shape is one such contoured surface. It is further preferred that the interface between the substrate and the cutting layer be free of ridges or edges. One meaning of the phrase "free of cutting edges" is intended to exclude, along with surfaces that don't define a continuous curve, those curves having a radius of curvature less than 0.060 inches.

It has been discovered that a cutting layer that is free of cutting edges will be more impact resistant and thus have a longer expected life. Similarly, contouring the interface and cutting surfaces improves fatigue resistance and reduces internal residual stresses. Hence, a preferred embodiment of the present inserts includes contoured surfaces on both the substrate and the cutting layer.

In each of the foregoing embodiments, it is possible to divide the cutting layer 14, the protrusion portion 35 and the extension portion 18 into two parts, by defining a plane passing through cutter element 10. One feature of the present invention can be described in terms of such a plane. Specifically, a plane passing through the substrate apex 20 and lying parallel to the insert axis 17 and normal to the radius $r_1$. The radius $r_1$ is defined geometrically as the line constructed perpendicularly from insert axis 17 to apex 20. In FIGS. 1 and 4–6, such a plane is normal to the plane of the paper as drawn. Referring again to FIG. 1, this plane is labeled P and divides cutting layer 14 into a major portion 32 and a minor portion 34. Likewise, the plane divides protrusion portion 35 into a first section 42 and a second section 44. The volume of cutter layer material in each cutting layer section 32, 34, and the volume of cutter protrusion in each protrusion section 42, 44 can be calculated. For ease of description, these volumes are referred to as $V_{cl-1}$, $V_{cl-2}$, $V_{p-1}$ and $V_{p-2}$, respectively (FIG. 1). Similarly, the volume of the entire cutting layer 14 ($V_{cl-1}$+$V_{cl-2}$) is referred to as $V_{cl}$ and the volume of the protrusion 35 ($V_{p-1}$+$V_{p-2}$) is referred to as $V_p$. Using the foregoing definitions, another preferred embodiment of the present invention can be described as a cutter element having a substrate surface and a cutting layer that are shaped such that the ratio of the volume of the major portion cutting layer to the total volume of the cutting layer ($V_{cl-1}/V_{cl}$) is at least 60 percent and more preferably about 62 percent. It is contemplated that, in certain embodiments the ratio is preferably at least 65 percent, and more preferably 75 percent. It is generally also preferred that the ratio ($V_{cl-1/Vcl}$) be less than 98 percent, and more preferably less than 80 percent. This configuration ensures that the diamond layer forms a cap over substrate apex. Alternatively, and more preferably in addition, it is preferred that the ratio $V_{cl}$:$V_p$ be at least 18 percent and more preferably between 25 and 98 percent. It is important to note that since the apex may or may not coincide with the insert axis, the dividing plane in the above embodiment may or may not coincide with the insert axis.

Another embodiment of the present invention is defined in terms of a plane P* that does pass through the insert axis. According to this embodiment, there exists a plane P* through the insert axis 17 that divides cutting layer 14 into two sections, one being a major section 52, which contains the maximum volume obtainable and the other being a minor section 54, which contains the minimum volume obtainable. This same plane P* also divides protrusion portion 18 into a first section 56 and a second section 58. The volume of cutter layer material in each cutting layer section 52, 54, and the volume of each cutter protrusion section 56, 58 can be calculated. These volumes are referred to herein as $V_{cl-1}$*, $V_{cl-2}$*, $V_{p1}$* and $V_{p2}$*, respectively (FIG. 1). In this embodiment, $V_{cl}$ and $V_p$ again refer to the total volume of cutting layer 14 and the total volume of cutter protrusion portion 18, respectively. Using the foregoing definitions, the present invention can be described as a cutter element having a substrate surface and a cutting layer that are shaped such that the volume of the major portion of the cutting layer to the total volume of the cutting layer ($V_{cl-1}$*/$V_{cl-total}$) is at least 60 percent, more preferably 60 to 98 percent, and still more preferably 75 to 98 percent. Alternatively, an embodiment is contemplated wherein the ratio $V_{cl-1}$*:$V_{p-1}$* is at least 60 percent and more preferably at least 70 percent and the ratio $V_{cl-1}$*:$V_{p-1}$* is greater than the ratio $V_{cl-2}$*: $V_{p-2}$*. Each of the foregoing embodiments contemplates a degree of asymmetry in the thickness of the cutting layer.

When the distribution of the ultrahard layer on the substrate becomes less symmetrical, and particularly when one region of the cutting layer is made thicker than the surrounding regions, the likelihood of delamination typically increases. In the present case, however, it has been discovered that the shape of the diamond/substrate interface can be designed so as to minimize this potential risk. More particularly, mathematical and mechanics models are used to optimize the shape of the interface. The resulting interface shape depends on the desired shape of the outer surface and the various properties and manufacturing history of the materials of the cutting layer and so cannot be described with particularity. Nevertheless, the underlying equations that allow optimization of the interface shape are as follows:

$$\sigma_{ij,j}+F_i=\rho\ddot{u}_i, \quad (1)$$

$$\epsilon_{ij}=\tfrac{1}{2}(u_{i,j}+u_{j,i}), \quad (2)$$

$$\sigma_{ij}=\delta_{ij}\lambda\epsilon_{kk}+2\mu\epsilon_{ij}-\delta_{ij}q(T-T_0), \text{ and} \quad (3)$$

$$h\mathrm{T}_{,mm}=\rho c_E(dT/dt), \quad (4)$$

where $\sigma_{ij}$ is a stress tensor, $\epsilon_{ij}$ is a strain tensor, $u_i$ is a displacement component, $\ddot{u}_i$ is the second derivative of $u_i$ with respect to time, T is the temperature, dT/dt is the first derivative of T with respect to time, F is the body force, and $\delta_{ij}$ is the Kronecker delta. The balance of the symbols, h, ρ, $c_E$, q, λ, and $\mu$ are physical constants. Various software packages that are capable of using the foregoing equations in combination with finite elements analysis to calculate the stress and strain distributions for a given material set, temperature, geometry, boundaries and load are commercially available and will be recognized by those skilled in the art. Optimizing the shape of the cutting layer can result in a reduction of the tensile contact stress by about 20–40% and can keep residual stresses at an acceptable level. The maximum thickness. For example, for an insert with a 0.44 inch diameter and 0.163 inch extension height, the thickness of a coating layer for a semi-round top cutting element with a certain smooth non-symmetrical substrate can be can be about 0.096 inch As disclosed above, the cutting layer of the present invention can comprise abrasive particles such as polycrystalline diamond or any other superhard abrasive, such as cubic boron nitride, diamond composite, etc. As used in this specification, the term polycrystalline diamond, along with its abbreviation "PCD," refers to the material produced by subjecting individual diamond crystals to sufficiently high pressure and high temperature that intercrystalline bonding occurs between adjacent diamond crystals. Generally, a catalyst/binder material such as cobalt is used to assure intercrystalline bonding. PCD is sometimes referred to in the art as "sintered diamond."

In an alternative embodiment of the present invention, the cutting layer comprises an ordered composite of diamond and a carbide material as disclosed in pending application 08/903668, filed on Jul. 31, 1997 and entitled "*Composite Construction with Oriented Microstructur*," which is incorporated herein by reference in its entirety. In a preferred embodiment, the ordered composite consists of multiple of small cells, each cell consisting of a polycrystalline diamond core surrounded by a tungsten carbide-cobalt boundary or matrix. Such a structure minimizes the failure area that is vulnerable to an impact or fatigue on the cutting surface.

It will be apparent that other ordered composites can be formed, with the shapes, sizes and numbers of the tubes and bundles, the composition of the components, and the direction of orientation varying depending on the desired properties of the composite.

In another alternate embodiment of the present invention, the cutting layer comprises a composite mixture of polycrystalline diamond and precemented tungsten carbide/cobalt, with a preferred ratio being sixty percent PCD and forty percent precemented tungsten carbide/cobalt. This particular composition has a greater impact resistance and acceptable wear resistance for many applications, particularly roller cone rock bits, where wear is not a typical failure mode with conventional diamond coated inserts. It has been found in laboratory impact testing that the use of one- and two-transition layer composite diamond mixtures significantly reduces the size and amount of damage to the diamond cutting surface. A useful discussion of transition layers can be found at U.S. Pat. No. 4,694,918 to Hall and U.S. Pat. No. 4,811,801 Salesky.

In addition to the foregoing, the concepts of the present invention can be used in conjunction with other techniques for improving cutter element durability and life. For example, the present cutting layer, having a region of exceptional thickness, can be combined with one or more transition layers. Suitable transitional layers include materials having a hardness that is intermediate between that of the cutting layer and that of the substrate. Alternatively, the present cutting layer can be combined with additional layers in a manner than provides a cutter element in which at least one of the layers is harder than at least one of the layers above it. The layers can further include one or more layers of polycrystalline diamond and can include a layer in which the composition of the material changes with distance from the substrate. In addition the present cutting layer can be designed, or combined with a layer that is designed, to include a region of residual compressive stress at its outer surface, which functions as a preload or prestress so as to offset the effect of localized loading due to contact with the formation during drilling. Further in accordance with the present invention, the thickness of the transition layer(s) may vary across the substrate surface and the thickest portion of the transition layer may or may not coincide with the thickest portion of the cutting layer.

The various embodiments illustrated in FIGS. 1 and 4–6 include interface shapes that have been optimized for the various cutter element shapes. It will be understood, however that the cutter element shapes to which the principles of the present invention can be applied are not limited to the embodiments shown. For example, the basic external shape of the cutter element can vary, and can be SRT, conical, chisel-shaped or relieved and can have positive or negative draft. In addition, the shape of the interface surface of the cutting layer can vary from those illustrated. In each instance, the present invention contemplates balancing the residual stresses with the mechanical load distribution to optimize the shape of the interface between the cutting layer and the substrate. This optimization allows substantial gains to be made in the localized enhancement of the cutting layer, thereby increasing cutter life.

While the cutter elements of the present invention have been described according to the preferred embodiments, it will be understood that departures can be made from some aspects of the foregoing description without departing from the spirit of the invention. For example, while the outer abrasive cutting surface of the cutting element of this invention is described in terms of a polycrystalline diamond layer, cubic boron nitride or wurtzite boron nitride or a combination of any of these superhard abrasive materials is also useful for the cutting surface or plane of the abrasive cutting element. Likewise, while the preferred substrate material comprises cemented or sintered carbide of one of the Group IVB, VB and VIB metals, which are generally pressed or sintered in the presence of a binder of cobalt, nickel, or iron or the alloys thereof, it will be understood that alternative suitable substrate materials can be used.

What is claimed is:

1. A cutter element for use in a drill bit, comprising:

a substrate comprising a grip portion and an extension portion, said grip portion having an insert axis and said extension portion having a substrate apex;

a superhard cutting layer affixed to said extension portion, said cutting layer covering said substrate apex and defining an interface surface on said extension portion, said interface surface being free of edges underneath said cutting layer, said cutting layer having a cutting surface defining a cutting apex that is offset from said substrate apex; and wherein said cutting layer and said extension portion are shaped such that a plane parallel to said insert axis can be passed through said insert axis to divide said cutting layer where the volume of said cutting layer on a first side of said plane is at least 60 percent of the total volume of said cutting layer.

2. The cutting element according to claim 1 wherein said substrate apex is offset from said insert axis.

3. The cutting element according to claim 1 wherein said cutting layer comprises at least two layers.

4. A cutter element for use in a drill bit, comprising:

a substrate comprising a grip portion and an extension portion, said grip portion having an insert axis and said extension portion having a substrate apex;

a superhard cutting layer affixed to said extension portion to define an interface surface on said extension portion and having a cutting surface defining a cutting apex that is offset from the substrate apex, said cutting layer covering said substrate apex; and wherein said cutting layer and said extension portion are shaped such that a plane parallel to said insert axis can be passed through said insert axis to divide said cutting layer such that the volume of said cutting layer on one side of said plane is at least 60 percent of the total volume of said cutting layer and wherein said cutting surface is axisymmetric.

5. The cutting element according to claim 4 wherein said cutting surface is hemispherical.

6. The cutting element according to claim 4 wherein said cutting layer comprises at least two layers.

7. A cutter element for use in a drill bit, comprising:

a substrate comprising a grip portion and an extension portion, said grip portion having an insert axis and said extension portion having a substrate apex;

a superhard cutting layer affixed to said extension portion to define an interface surface on said extension portion and having a cutting surface defining a cutting apex that is offset from the substrate apex, said cutting layer covering said substrate apex; and wherein said cutting layer and said extension portion are shaped such that a plane parallel to said insert axis can be passed through said insert axis to divide said cutting layer such that the volume of said cutting layer on one side of said plane is at least 60 percent of the total volume of said cutting layer and wherein said cutting surface is free of cutting edges.

8. The cutting element according to claim 7 wherein said cutting layer comprises at least two layers.

9. A cutter element for use in a drill bit, comprising:

a substrate comprising a grip portion and an extension portion, said grip portion having an insert axis and said extension portion having a substrate apex;

a superhard cutting layer affixed to said extension portion to define an interface surface on said extension portion and having a cutting surface defining a cutting apex that is offset from the substrate apex, said cutting layer covering said substrate apex; and wherein said cutting layer and said extension portion are shaped such that a plane parallel to said insert axis can be passed through said insert axis to divide said cutting layer such that the volume of said cutting layer on a first side of said plane is at least 75 percent of the total volume of said cutting layer.

10. The cutting element according to claim 9 wherein said cutting layer comprises at least two layers.

11. A cutter element for use in a drill bit, comprising:

a substrate comprising a grip portion and an extension portion, said grip portion having an insert axis and said extension portion having a substrate apex; and a superhard cutting layer affixed to said extension portion so as to define an interface surface on said extension portion and having a cutting surface defining a cutting apex that is offset from the substrate apex, said cutting layer covering said substrate apex;

wherein said substrate and said cutting layer are shaped such that:

said insert axis does not pass through said substrate apex, and a plane parallel to said insert axis can be passed through said substrate apex to divide said cutting layer such that the volume of said cutting layer on a first side of said plane is at least 75 percent of the total volume of said cutting layer.

12. The cutting element according to claim 11 wherein said cutting layer comprises at least two layers.

13. A cutter element for use in a drill bit, comprising:

a substrate comprising a grip portion and an extension portion, said grip portion having an insert axis and said extension portion having a substrate apex; and a superhard cutting layer affixed to said extension portion, said cutting layer covering said substrate apex;

wherein said substrate and said cutting layer are shaped such that a plane parallel to said insert axis and passing through said substrate apex divides said cutting layer such that the volume of said cutting layer on a first side of said plane is at least 60 percent of the total volume of said cutting layer; and wherein said cutting surface is axisymmetric.

14. The cutting element according to claim 13 wherein said volume of said cutting layer on a first side of said plane is at least 75 percent of the total volume of said cutting layer.

15. The cutting element according to claim 13 wherein said cutting layer comprises at least two layers.

16. The cutting element according to claim 13 wherein said cutting surface is hemispherical.

17. A cutter element for use in a drill bit, comprising:

a substrate comprising a grip portion and an extension portion, said grip portion having an insert axis, said extension portion having a volume $V_{ext}$;

a superhard cutting layer affixed to said extension portion so as to define an interface surface on said extension portion and having a cutting surface defining a cutting apex, said interface surface being free of edges underneath said cutting layer, the entire cutting layer having a volume $V_{cl}$;

said extension portion and said cutting layer being configured such that a plane P* parallel to said insert axis can be passed through said insert axis such that the ratio of the volume of said cutting layer on a first side of said plane P* to the total volume on said first side of said plane ($Vcl-1^*:(V_{ext-1}^*+V_{cl-1}^*)$) is at least 60 percent and less than 98% and the same ratio ($V_{cl-1}^*:(V_{ext-1}^*+V_{cl-1}^*)$) is greater than a corresponding ratio on a second side of said plane ($V_{cl-2^*:(Vext-2}^*+V_{cl-2}^*)$); and wherein the cutting layer volume on said first side of said plane, $V_{cl-1}^*$, is at least 60 percent of the said total cutting layer volume, $V_{cl}$.

18. The cutting element according to claim 17 wherein said ratio of the volume of the cutting layer on a first side of said plane P* to the total volume on said first side of said plane ($V_{cl-1}$*: ($V_{ext-1}$*+$V_{cl-1}$*)) is at least 75 percent.

19. The cutting element according to claim 17 wherein said ratio of the volume of the cutting layer on a first side of said plane P* to the total volume on said first side of said plane ($V_{cl-1}$*: ($V_{ext-1}$*+$V_{cl-1}$*)) is less than 80 percent.

20. The cutting element according to claim 17 wherein said cutting layer comprises at least two layers.

21. A cutter element for use in a drill bit, comprising:

a substrate comprising a grip portion and an extension portion, said grip portion having an insert axis and said extension portion having a volume $V_{ext}$; and a superhard cutting layer affixed to the extension portion so as to define an interface surface on said extension portion and having a chisel-shaped cutting surface having a crest, said entire cutting layer having a volume $V_{cl}$;

said extension portion and said cutting layer being configured such that a plane P* parallel to said insert axis can be passed through said insert axis such that the ratio of the volume of said cutting layer on a first side of said plane P* to the total volume on said first side of said plane ($V_{cl-1}$*:($V_{ext-1}$*+$V_{cl-1}$*)) is at least 60 percent and less than 98% and the same ratio ($V_{cl-1}$*:($V_{ext-1}$*+$V_{cl-1}$*)) is greater than a corresponding ratio on a second side of said plane ($V_{cl-2}$*:($V_{ext-2}$*+$V_{cl-2}$*)); and wherein the cutting layer volume on said first side of said plane, $V_{cl-1}$*, is at least 60 percent of the said total cutting layer volume, $V_{cl}$.

22. The cutter element according to claim 21 the crest is inclined relative to the plane of intersection between said grip portion and said extension portion.

23. The cutting element according to claim 21 wherein said cutting layer comprises at least two layers.

24. The cutting element according to claim 21 wherein volume of said cutting layer on a first side of said plane is at least 75 percent of the total volume of said cutting layer.

* * * * *